US007275036B2

(12) United States Patent
Geiger et al.

(10) Patent No.: US 7,275,036 B2
(45) Date of Patent: Sep. 25, 2007

(54) APPARATUS AND METHOD FOR CODING A TIME-DISCRETE AUDIO SIGNAL TO OBTAIN CODED AUDIO DATA AND FOR DECODING CODED AUDIO DATA

(75) Inventors: Ralf Geiger, Wuembach (DE); Thomas Sporer, Fuerth (DE); Karlheinz Brandenburg, Erlangen (DE); Juergen Herre, Erlangen (DE); Juergen Koller, Wuembach (DE); Joachim Deguara, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 243 days.

(21) Appl. No.: 10/966,780

(22) Filed: Oct. 15, 2004

(65) Prior Publication Data

US 2005/0114126 A1 May 26, 2005

Related U.S. Application Data

(63) Continuation of application No. PCT/EP02/13623, filed on Dec. 2, 2002.

(30) Foreign Application Priority Data

Apr. 18, 2002 (DE) ..... 102 17 297

(51) Int. Cl.
*G10L 19/00* (2006.01)

(52) U.S. Cl. ..... 704/500; 704/200.1

(58) Field of Classification Search ..... 704/500–504, 704/200.1

See application file for complete search history.

(56) References Cited

U.S. PATENT DOCUMENTS

| | | | | |
|---|---|---|---|---|
| 5,357,594 | A * | 10/1994 | Fielder | 704/200.1 |
| 5,812,971 | A * | 9/1998 | Herre | 704/230 |
| 5,909,664 | A * | 6/1999 | Davis et al. | 704/200.1 |
| 6,021,386 | A * | 2/2000 | Davis et al. | 704/229 |
| 6,611,800 | B1 * | 8/2003 | Nishiguchi et al. | 704/221 |
| 6,636,830 | B1 * | 10/2003 | Princen et al. | 704/204 |

OTHER PUBLICATIONS

Moriya, T., et al. *A Design of Lossy and Lossless Scalable Audio Coding*. IEEE. 2000.

Geiger, R., et al. *Audio Coding Based on Integer Transforms*. Audio Engineering Society. Sep. 21-24, 2001. New York, NY.

(Continued)

*Primary Examiner*—Michael N Opsasnick

(74) *Attorney, Agent, or Firm*—Michael A. Glenn; Glenn Patent Group

(57) ABSTRACT

A time-discrete audio signal is processed to provide a quantization block with quantized spectral values. Furthermore, an integer spectral representation is generated from the time-discrete audio signal using an integer transform algorithm. The quantization block having been generated using a psychoacoustic model is inversely quantized and rounded to then form a difference between the integer spectral values and the inversely quantized rounded spectral values. The quantization block alone provides a lossy psychoacoustically coded/decoded audio signal after the decoding, whereas the quantization block, together with the combination block, provides a lossless or almost lossless coded and again decoded audio signal in the decoding. By generating the differential signal in the frequency domain, a simpler coder/decoder structure results.

34 Claims, 8 Drawing Sheets

OTHER PUBLICATIONS

Hans, M., et al. *Lossless Compression of Digital Audio*. IEEE Signal Processing Magazine. Jul. 2001.

Noll, P., et al. *Digital Audio: From Lossless to Transparent Coding*. IEEE Signal Processing Workshop. 1999. Poznan.

Geiger, R., et al. *INTMDCT—A Link Between Perceptual and Lossless Audio Coding*. IEEE. 2000.

Raad, M., et al. *From Lossy to Lossless Audio Coding Using SPIHT*.

* cited by examiner

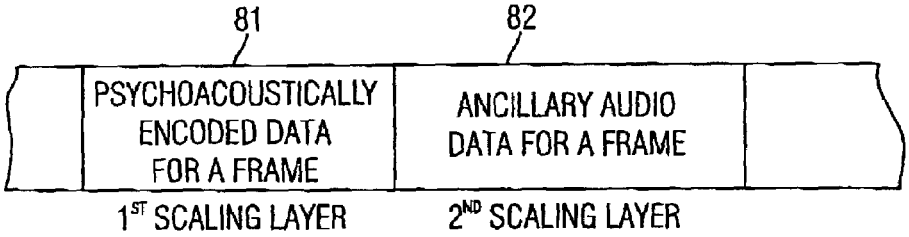
FIG. 8a
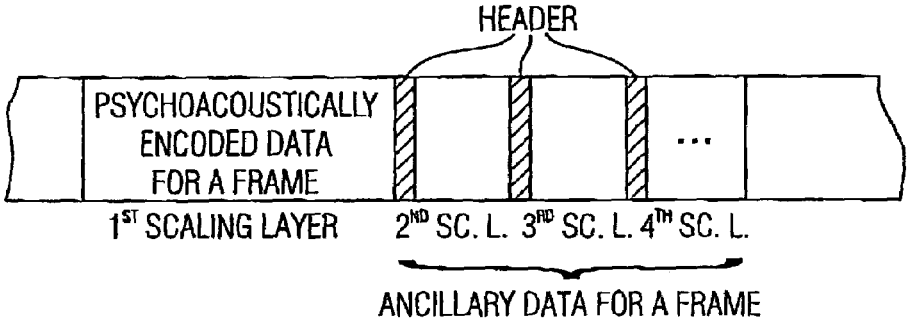
FIG. 8b
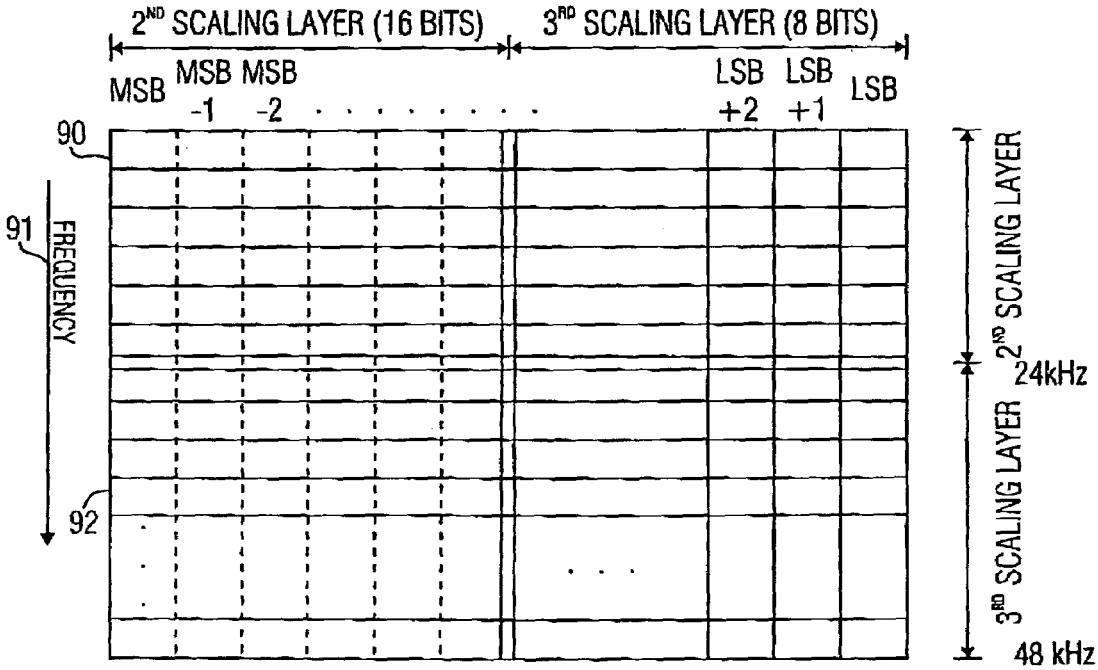
FIG. 9 (DIFFERENCE SPECTRAL VALUES)

APPARATUS AND METHOD FOR CODING A TIME-DISCRETE AUDIO SIGNAL TO OBTAIN CODED AUDIO DATA AND FOR DECODING CODED AUDIO DATA

CROSS-REFERENCE TO RELATED APPLICATION

This application is a continuation of co-pending International Application No. PCT/EP02/13623, filed Dec. 02, 2002, which designated the United States and was not published in English and is incorporated herein by reference in its entirety.

BACKGROUND OF THE INVENTION

1. Field of the Invention

The present invention relates to the audio coding/decoding, and in particular to scalable coding/decoding algorithms with a psychoacoustic first scaling layer and a second scaling layer including ancillary audio data for lossless decoding.

2. Description of the Related Art

Modern audio coding methods, such as MPEG Layer3 (MP3) or MPEG AAC, use transforms, such as the so-called modified discrete cosine transform (MDCT), to obtain a block-wise frequency representation of an audio signal. Such an audio coder usually obtains a stream of time-discrete audio samples. A stream of audio samples is windowed to obtain a windowed block of for example 1,024 or 2,048 windowed audio samples. For the windowing, various window functions are employed, such as a sine window, etc.

The windowed time-discrete audio samples are then converted to a spectral representation by means of a filter bank. In principle, a Fourier transform, or a variety of the Fourier transform for special reasons, such as a FFT or, as has been set forth, a MDCT, may be employed for this. The block of audio spectral values at the output of the filter bank may then be processed further depending on demand. In the above-referenced audio coders, a quantization of the audio spectral values follows, wherein the quantization stages are typically chosen so that the quantization noise introduced by the quantizing lies below the psychoacoustic masking threshold, i.e. is "masked away". The quantization is a lossy coding. In order to obtain further data amount reduction, the quantized spectral values are then entropy coded for example by means of Huffman coding. By adding side information, such as scale factors etc., a bit stream, which may be stored or transmitted, is formed from the entropy-coded quantized spectral values by means of a bit stream multiplexer.

In the audio decoder, the bit stream is split up in coded quantized spectral values and side information by means of a bit stream de-multiplexer. The entropy-coded quantized spectral values are at first entropy decoded to obtain the quantized spectral values. The quantized spectral values are then inversely quantized to obtain decoded spectral values comprising quantization noise, which, however, lies below the psychoacoustic masking threshold and will thus be inaudible. These spectral values are then converted into a temporal representation by means of a synthesis filter bank to obtain time-discrete decoded audio samples. In the synthesis filter bank, a transform algorithm inverse to the transform algorithm has to be employed. Moreover, the windowing has to be cancelled after the frequency-time inverse or backward transform.

In order to achieve good frequency selectivity, modern audio coders typically use block overlap. Such a case is illustrated in FIG. 4*a*. At first for example 2,048 time-discrete audio samples are taken and windowed by means of means 402. The window embodying means 402 has a window length of 2N samples and provides a block of 2N windowed samples at the output side. In order to achieve window overlap, by means of means 404, which is illustrated separate from means 402 only for clarity reasons in FIG. 4*a*, a second block of 2N windowed samples is formed. The 2,048 samples fed to means 404, however, are not the time-discrete audio samples immediately ensuing the first window, but contain the second half of the samples windowed by means 402 and additionally contain only 1,024 "new" samples. The overlap is symbolically illustrated by means 406 in FIG. 4*a*, causing an overlapping degree of 50%. Both the 2N windowed samples output by means 402 and the 2N windowed samples output by means 404 are then subjected to the MDCT algorithm by means of means 408 and 410, respectively. Means 408 provides N spectral values for the first window according to the known MDCT algorithm, whereas means 410 also provides N spectral values, but for the second window, wherein there is an overlap of 50% between the first window and the second window.

In the decoder, the N spectral values of the first window, as it is shown in FIG. 4*b*, are fed to means 412 performing an inverse modified discrete cosine transform. The same applies for the N spectral values of the second window. These are fed to means 414 also performing an inverse modified discrete cosine transform. Both means 412 and means 414 each provide 2N samples for the first window and 2N samples for the second window, respectively.

In means 416, designated with TDAC (time domain aliasing cancellation) in FIG. 4*b*, the fact is taken into account that the two windows are overlapping. In particular, a sample $y_1$ of the second half of the first window, i.e. with an index N+k, is summed with a sample $y_2$ from the first half of the second window, i.e. with an index k, so that N decoded temporal samples result at the output side, i.e. in the decoder.

It is to be noted that by the function of means 416, which is also referred to as add function, the windowing performed in the coder schematically illustrated by FIG. 4*a* is taken into account somewhat automatically, so that in the decoder illustrated by FIG. 4*b* no explicit "inverse windowing" has to take place.

When the window function implemented by means 402 or 404 is designated with w(k), wherein the index k represents the time index, the condition has to be met that the squared window weight w(k) added to the squared window weight w(N+k) together are 1, wherein k runs from 0 to N−1. When a sine window is used, the window weights of which follow the first half-wave of the sine function, this condition is always met, since the square of the sine and the square of the cosine for each angle together result in the value 1.

Disadvantageous in the window method with ensuing MDCT function described in FIG. 4*a* is the fact that the windowing by multiplication of a time-discrete sample, when it is thought of a sine window, it is achieved with a floating-point number, since the sine of an angle between 0 and 180 degrees does not yield an integer, apart from the angle 90 degrees. Even when integer time-discrete samples are windowed, floating-point numbers result after the windowing.

Therefore, even when no psychoacoustic coder is used, i.e. when lossless coding is to be achieved, quantization is necessary at the output of means 408 or 410 to be able to perform reasonably manageable entropy coding.

When known transforms, as they have been described on the basis of FIG. 4*a*, are to be employed for lossless audio coding, either very fine quantization has to be employed to be able to neglect the resulting error due to rounding the floating-point numbers, or the error signal has to be additionally coded for example in the time domain.

Concepts of the former kind, i.e. in which the quantization is so finely adjusted that the resulting error due to the rounding of the floating-point numbers is negligible, are for example disclosed in the German patent DE 197 42 201 C1. Here, an audio signal is converted to its spectral representation and quantized to obtain quantized spectral values. The quantized spectral values are then inversely quantized, converted to the time domain, and compared with the original audio signal. If the error, i.e. the error between the original audio signal and the quantized/inversely quantized audio signal, lies above an error threshold, the quantizer is more finely adjusted in feedback, and the comparison is performed again. The iteration is terminated, when the error threshold is underrun. The maybe still present residual signal is coded with a time domain coder and written into a bit stream including, apart from the time-domain-coded residual signal, also coded spectral values having been quantized according to the quantizer adjustments that were present at the time of the cancellation of the iteration. It is to be noted that the quantizer does not have to be controlled from a psychoacoustic model, so that the coded spectral values are typically quantized more accurately than this would have to be due to the psychoacoustic model.

In the publication "A Design of Lossy and Lossless Scalable Audio Coding", T. Moriya et al., Proc. ICASSP, 2000, a scalable coder is described, which includes e.g. an MPEG coder as first lossy data compression module, which has a block-wise digital signal form as input signal and generates the compressed bit stream. In an also present local decoder the coding is cancelled again, and a coded/decoded signal is generated. This signal is compared with the original input signal by subtracting the coded/decoded signal from the original input signal. The error signal is then fed to a second module, where a lossless bit conversion is used. This conversion has two steps. The first step consists in a conversion from a two's complement format to a presign-magnitude format. The second step consists in a conversion from a vertical magnitude sequence to a horizontal bit sequence in a processing block. The lossless data conversion is executed to maximize the number of zeros or to maximize the number of successive zeros in a sequence, in order to achieve an as-good-as-possible compression of the temporal error signal present as a result of digital numbers. This principle is based on a bit slice arithmetic coding (BSAC) scheme illustrated in the publication "Multi-Layer Bit Sliced Bit Rate Scalable Audio Coder", 103$^{rd}$ AES Convention, Preprint No. 4520, 1997.

Disadvantageous in the above-described concepts is the fact that the data for the lossless expansion layer, i.e. the ancillary data required to achieve lossless decoding of the audio signal has to be obtained in the time domain. This means that complete decoding including a frequency/time conversion is required to obtain the coded/decoded signal in the time domain, so that by means of a sample-wise difference formation between the original audio input signal and the coded/decoded audio signal, which is lossy due to the psychoacoustic coding, the error signal is calculated. This concept is particularly disadvantageous in that in the coder generating the audio data stream both complete time/frequency conversion means, such as a filter bank or e.g. a MDCT algorithm, is required for the forward transform, and at the same time, only to generate the error signal, a complete inverse filter bank or a complete synthesis algorithm is required. The coder thus, in addition to its inherent coder functionalities, also has to contain the complete decoder functionality. If the coder is implemented in software, both storage capacities and processor capacities are required for this, leading to a coder implementation with increased expenditure.

SUMMARY OF THE INVENTION

The object of the present invention is to provide a less expensive concept, by which an audio data stream may be generated, which may be decoded in an at least almost lossless manner.

In accordance with a first aspect, the present invention provides an apparatus for coding a time-discrete audio signal to obtain coded audio data, having: a quantizer for providing a quantization block of spectral values of the time-discrete audio signal quantized using a psychoacoustic model; an inverse quantizer for inversely quantizing the quantization block and for rounding the inversely quantized spectral values to obtain a rounding block of rounded inversely quantized spectral values; a generator for generating an integer block of integer spectral values using an integer transform algorithm formed to generate the integer block of spectral values from a block of integer time-discrete samples; a combiner for forming a difference block depending on a spectral value-wise difference between the rounding block and the integer block, to obtain a difference block with difference spectral values; and a processor for processing the quantization block and the difference block to generate coded audio data including information on the quantization block and information on the difference block.

In accordance with a second aspect, the present invention provides a method of coding a time-discrete audio signal to obtain coded audio data, with the steps of: providing a quantization block of spectral values of a time-discrete audio signal quantized using a psychoacoustic model; inversely quantizing the quantization block and rounding the inversely quantized spectral values to obtain a rounding block of rounded inversely quantized spectral values; generating an integer block of integer spectral values using an integer transform algorithm formed to generate the integer block of spectral values from a block of integer time-discrete samples; forming a difference block depending on a spectral value-wise difference between the rounding block and the integer block, to obtain a difference block with difference spectral values; and processing the quantization block and the difference block to generate coded audio data including information on the quantization block and information on the difference block.

In accordance with a third aspect, the present invention provides an apparatus for decoding coded audio data having been generated from a time-discrete audio signal by providing a quantization block of spectral values of the time-discrete audio signal quantized using a psychoacoustic model, by inversely quantizing the quantization block and rounding the inversely quantized spectral values to obtain a rounding block of rounded inversely quantized spectral values, by generating of an integer block of integer spectral values using an integer transform algorithm formed to generate the integer block of spectral values from a block of integer time-discrete samples, and by forming a difference block depending on a spectral value-wise difference between the rounding block and the integer block, to obtain a difference block with difference spectral values, having: a processor for processing the coded audio data to obtain a quantization block and a difference block; an inverse quantizer for inversely quantizing and rounding the quantization block to obtain an integer inversely quantized quantization block; a combiner for spectral value-wise combining the integer quantization block and the difference block to obtain a combination block; and a generator for generating a temporal representation of the time-discrete audio signal using the combination block and using an integer transform algorithm inverse to the integer transform algorithm.

In accordance with a fourth aspect, the present invention provides a method of decoding coded audio data having been generated from a time-discrete audio signal by providing, inversely quantizing, generating, forming, and processing, with the steps of: processing the coded audio data to obtain a quantization block and a difference block; inversely quantizing the quantization block and rounding to obtain an integer inversely quantized quantization block; spectral value-wise combining the integer quantization block and the difference block to obtain a combination block; and generating a temporal representation of the time-discrete audio signal using a combination block and using an integer transform algorithm inverse to the integer transformation algorithm.

In accordance with a fifth aspect, the present invention provides a computer program with a program code for performing, when the program is executed on a computer, the method of coding a time-discrete audio signal to obtain coded audio data, with the steps of: providing a quantization block of spectral values of a time-discrete audio signal quantized using a psychoacoustic model; inversely quantizing the quantization block and rounding the inversely quantized spectral values to obtain a rounding block of rounded inversely quantized spectral values; generating an integer block of integer spectral values using an integer transform algorithm formed to generate the integer block of spectral values from a block of integer time-discrete samples; forming a difference block depending on a spectral value-wise difference between the rounding block and the integer block, to obtain a difference block with difference spectral values; and processing the quantization block and the difference block to generate coded audio data including information on the quantization block and information on the difference block.

In accordance with a sixth aspect, the present invention provides a computer program with a program code for performing, when the program is executed on a computer, the method of decoding coded audio data having been generated from a time-discrete audio signal by providing, inversely quantizing, generating, forming, and processing, with the steps of: processing the coded audio data to obtain a quantization block and a difference block; inversely quantizing the quantization block and rounding to obtain an integer inversely quantized quantization block; spectral value-wise combining the integer quantization block and the difference block to obtain a combination block; and generating a temporal representation of the time-discrete audio signal using a combination block and using an integer transform algorithm inverse to the integer transformation algorithm.

The present invention is based on the finding that the ancillary audio data enabling lossless decoding of the audio signal may be obtained by providing a block of quantized spectral values as usual and then inversely quantizing it in order to have inversely quantized spectral values, which are lossy due to the quantization by means of a psychoacoustic model. These inversely quantized spectral values are then rounded to obtain a rounding block of rounded inversely quantized spectral values. As reference for the difference formation, according to the invention, an integer transform algorithm is used, which generates an integer block of spectral values only comprising integer spectral values from a block of integer time-discrete samples. According to the invention, now the combination of the spectral values in the rounding block and in the integer block is performed spectral value-wise, i.e. in the frequency domain, so that in the coder itself no synthesis algorithm, i.e. an inverse filter bank or an inverse MDCT algorithm, etc., is required. The combination block comprising the difference spectral values only includes integer values, which may be entropy coded in some known manner, due to the integer transformation algorithm and the rounded quantization values. It is to be noted that arbitrary entropy coders may be employed for the entropy coding of the combination block, such as Huffman coders or arithmetic coders, etc.

For the coding of the quantized spectral values of the quantization block, also arbitrary coders may be employed, such as the known tools usual for modern audio coders.

It is to be noted that the inventive coding/decoding concept is compatible with modern coding tools, such as window switching, TNS, or center/side coding for multichannel audio signals.

In a preferred embodiment of the present invention, a MDCT is employed for providing a quantization block of spectral values quantized using a psychoacoustic model. In addition, it is preferred to employ a so-called IntMDCT as integer transform algorithm.

In an alternative embodiment of the present invention, it can be done without the usual MDCT, and the IntMDCT may be used as approximation for the MDCT, namely in that the integer spectrum obtained by the integer transform algorithm is fed to a psychoacoustic quantizer to obtain quantized IntMDCT spectral values, which are then again inversely quantized and rounded to be compared with the original integer spectral values. In this case only a single transform is required, namely the IntMDCT generating integer spectral values from integer time-discrete samples.

Typically, processors work with integers, or each floating-point number may be represented as an integer. If an integer arithmetic is used in a processor, it can be done without the rounding of the inversely quantized spectral values, since due to the arithmetic of the processor rounded values, namely within the accuracy of the LSB, i.e. the least significant bit, are present anyway. In this case, completely lossless processing is achieved, i.e. processing within the accuracy of the used processor system. Alternatively, however, rounding to a rougher accuracy may be performed, in that the difference signal in the combination block is rounded to an accuracy fixed by a rounding function. Introducing rounding beyond the inherent rounding of the processor system enables flexibility in so far as to affect the "degree" of the losslessness of the coding, in order to generate an almost lossless coder in the sense of data compression.

The inventive decoder distinguishes itself by both the psychoacoustically coded audio data and the ancillary audio data being extracted from the audio data, being subjected to possibly present entropy decoding, and then being processed as follows. At first the quantization block in the decoder is inversely quantized and rounded using the same rounding function also employed in the coder, in order to be then added to the entropy-decoded ancillary audio data. In the decoder, then both a psychoacoustically compressed spectral representation of the audio signal and a lossless representation of the audio signal are present, wherein the psychoacoustically compressed spectral representation of the audio signal is to be converted to the time domain to obtain a lossy coded/decoded audio signal, whereas the lossless representation is converted in the time domain using an integer transform algorithm inverse to the integer transform algorithm to obtain a losslessly or, as it has been set forth, almost losslessly coded/decoded audio signal.

BRIEF DESCRIPTION OF THE DRAWINGS

These and other objects and features of the present invention will become clear from the following description taken in conjunction with the accompanying drawings, in which:

FIG. 8*a* is a schematic illustration of a bit stream with a first scaling layer and a second scaling layer;

FIG. 8*b* is a schematic illustration of a bit stream with a first scaling layer and several further scaling layers; and FIG. 9 is a schematic illustration of binarily coded difference spectral values for the illustration of possible scalings with regard to the accuracy (bits) of the difference spectral values and/or with regard to the frequency (sample rate) of the difference spectral values.

DESCRIPTION OF THE PREFERRED EMBODIMENTS

Figure 6:
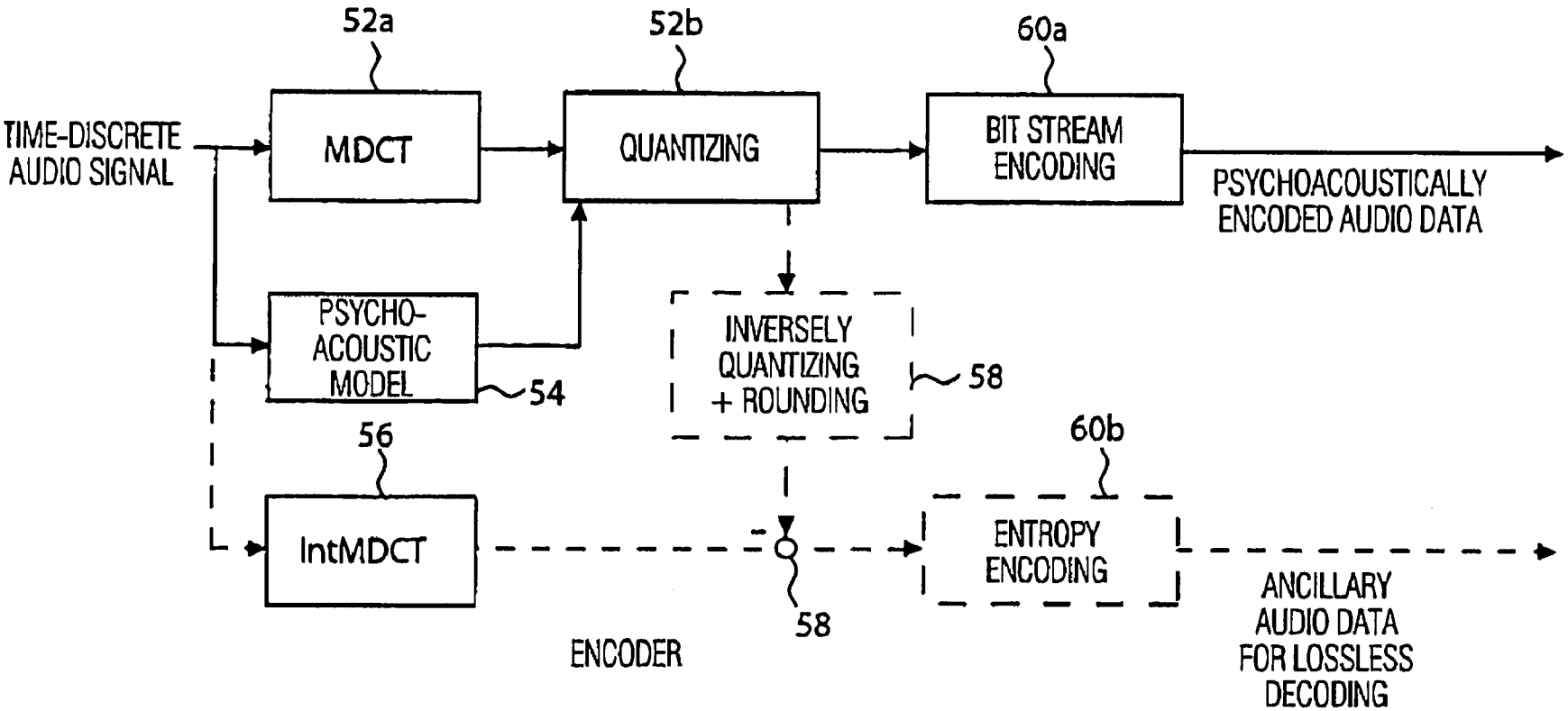
FIG. 6 is a principle block circuit diagram of an alternative inventively preferred coder.
Figure 7:
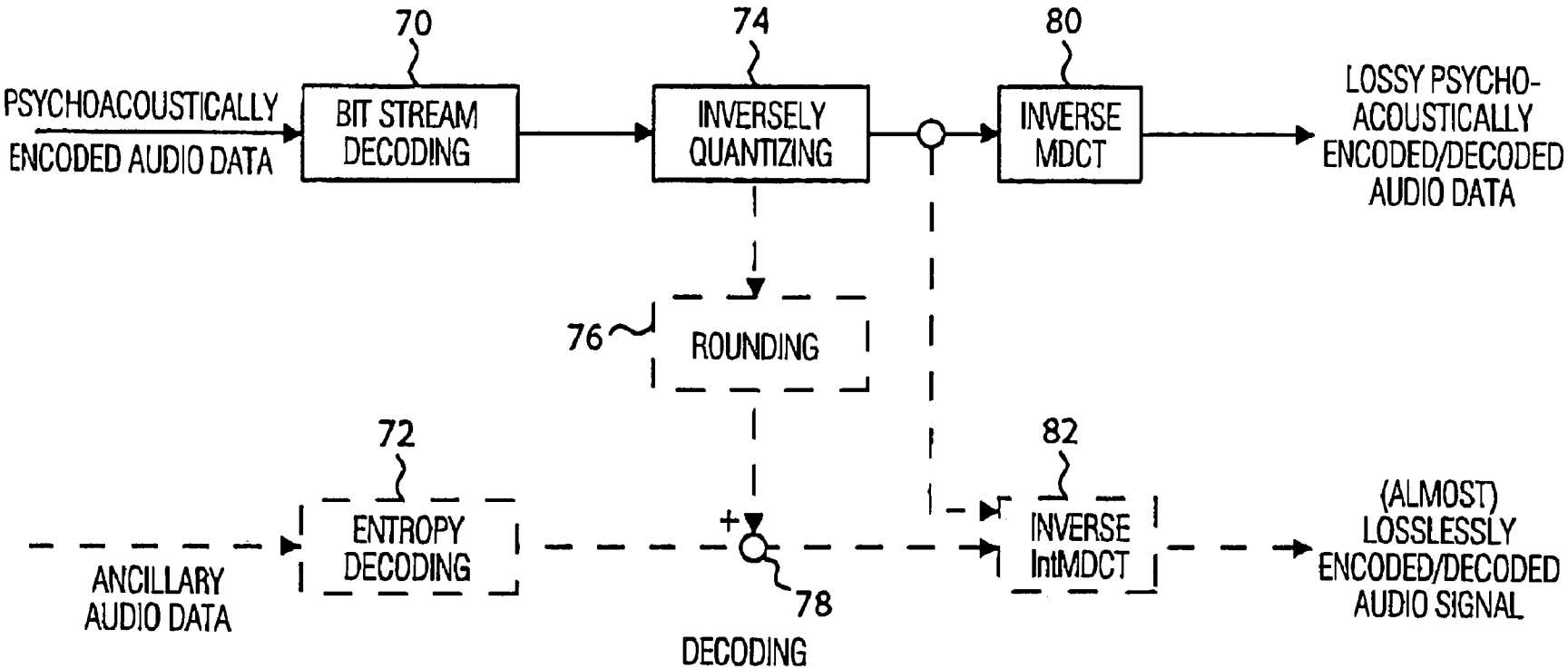
FIG. 7 is a principle block circuit diagram of an inventively preferred decoder.

In the following, on the basis of FIGS. 5 to 7, it is gone into inventive coder circuits (FIG. 5 and FIG. 6) or an inventively preferred decoder circuit (FIG. 7). The inventive coder shown in FIG. 5 includes an input 50, to which a time-discrete audio signal may be fed, as well as an output 52, from which coded audio data may be output. The time-discrete audio signal fed at the input 50 is fed to means 52 for providing a quantization block, which provides a quantization block of the time-discrete audio signal at the output side, which comprises quantized spectral values of the time-discrete audio signal 50 using a psychoacoustic model 54. The inventive coder further includes means for generating an integer block using an integer transform algorithm 56, wherein the integer algorithm is operative to generate integer spectral values from integer time-discrete samples.

The inventive coder further includes means 58 for inversely quantizing the quantization block output from means 52 and, when another accuracy than the processor accuracy is required, a rounding function. If it has to be gone up to the accuracy of the processor system, as it has been set forth, the rounding function already is inherently contained in the inversely quantizing of the quantization block, since a processor having an integer arithmetic is incapable of providing non-integer values anyway. Means 58 thus provides a so-called rounding block including inversely quantized spectral values, which are integer, i.e. have been inherently or explicitly rounded. Both the rounding block and the integer block are fed to combining means providing a difference block with difference spectral values, using difference formation, wherein the term "difference block" is to imply that the difference spectral values are values including differences between the integer block and the rounding block.

Both the quantization block output from means 52 and the difference block output from the difference formation means 58 are fed to processing means 60 performing for example usual processing of the quantization block and also causing for example entropy coding of the difference block. Means 60 for processing outputs coded audio data at the output 52, which contains both information on the quantization block and includes information on the difference block.

In a first preferred embodiment, as shown in FIG. 6, the time-discrete audio signal is converted to its spectral representation by means of a MDCT and then quantized. The means 52 for providing the quantization block thus consists of the MDCT means 52*a* and a quantizer 52*b*.

In addition, it is preferred to generate the integer block with an IntMDCT 56 as integer transform algorithm.

Figure 5:
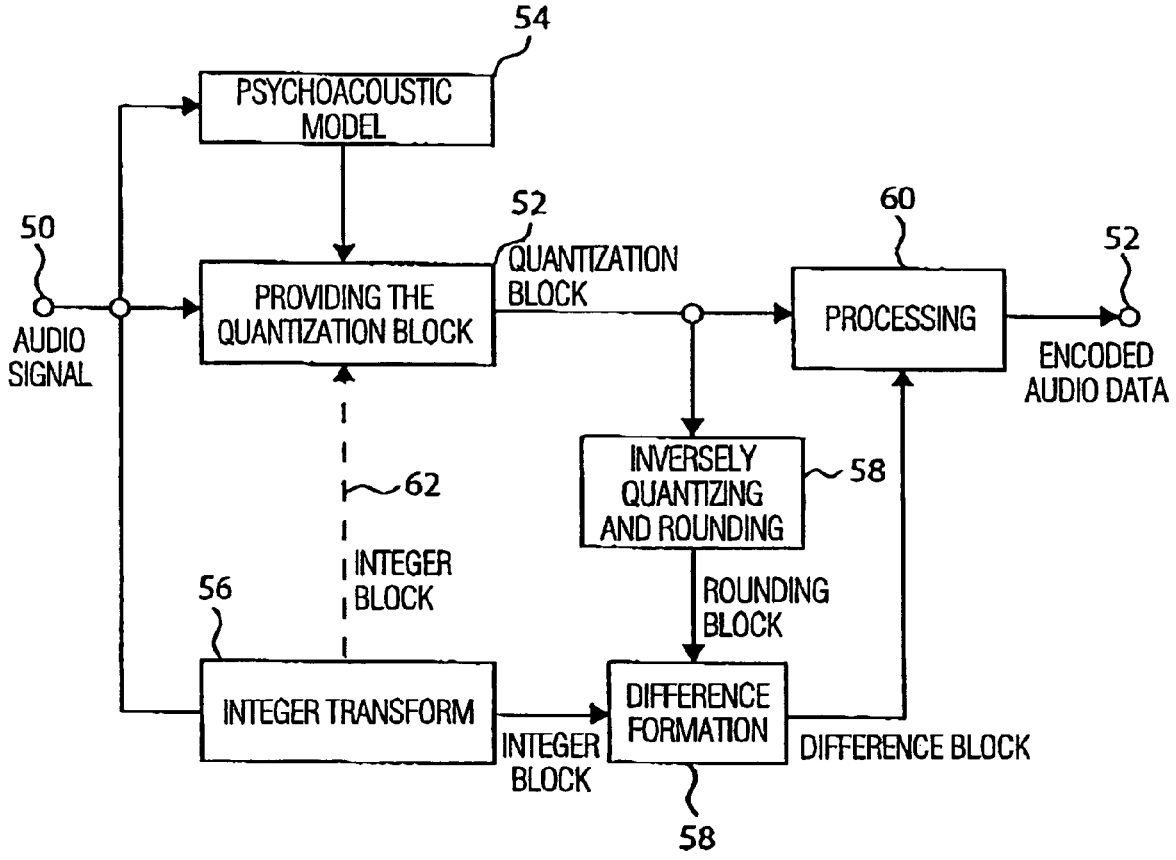
FIG. 5 is a principle block circuit diagram of a preferred inventive coder.

In FIG. 6, the processing means 60 shown in FIG. 5 is also illustrated as bit stream coding means 60*a* for bit stream coding the quantization block output by means 52*b*, as well as by an entropy coder 60*b* for entropy coding the difference block. The bit stream coder 60*a* outputs the psychoacoustically coded audio data, whereas the entropy coder 60*b* outputs an entropy-coded difference block. The two output data of blocks 60*a* and 60*b* may be combined in a bit stream in a suitable manner, which has the psychoacoustically coded audio data as first scaling layer and which has the additional audio data for lossless decoding as second scaling layer. The scaled bit stream then corresponds to the coded audio data shown in FIG. 5 at the output 52 of the coder.

In an alternative preferred embodiment, it may be done without the MDCT block 52*a* of FIG. 6, as it is implied in FIG. 5 by a dashed arrow 62. In this case the integer spectrum provided by the integer transform means 56 is both fed to the difference formation means 58 and to the quantizer 52*b* of FIG. 6. The spectral values generated by the integer transform are here in a way used as approximation for a usual MDCT spectrum. This embodiment has the advantage that only the IntMDCT algorithm is present in the coder, and that not both the IntMDCT algorithm and the MDCT algorithm have to be present in the coder.

Again referring to FIG. 6, it is to be noted that the solid blocks and lines illustrate a usual audio coder according to one of the MPEG standards, whereas the dashed blocks and lines illustrate the extension of such a usual MPEG coder. It is thus to be seen that no fundamental change of the usual MPEG coder is necessary, but that the inventive capture of the ancillary audio data for lossless coding by means of an integer transform may be added without change to the coder/decoder basic structure.

FIG. 7 shows a principle block circuit diagram of an inventive decoder for decoding the coded audio data output at the output 52 of FIG. 5. This is at first split up into psychoacoustically coded audio data on the one hand and the ancillary audio data on the other hand. The psychoacoustically coded audio data is fed to a usual bit stream decoder 70, whereas the ancillary audio data, when having been entropy coded in the coder, is entropy coded by means of an entropy coder 72. At the output of the bit stream decoder 70 of FIG. 7, quantized spectral values are present, which are fed to an inverse quantizer 74, which may in principle be constructed identically with the inverse quantizer in the means of FIG. 6. If an accuracy is aimed at, which does not correspond to the processor accuracy, in the decoder also rounding means 76 is provided, which performs the same algorithm or the same rounding function for mapping a real number to an integer, as it may be also implemented in the means 58 of FIG. 6. In a decoder-side combiner 78, the rounded inversely quantized spectral values are preferably additively combined spectral value-wise with the entropy-coded ancillary audio data, so that in the decoder on the one hand inversely quantized spectral values are present at the output of means 74 and on the other hand integer spectral values are present at the output of the combiner 78.

The output-side spectral values of means 74 may then be converted to the time domain by means of means 80 for performing an inverse modified discrete cosine transform, to obtain a lossy psychoacoustically coded and again decoded audio signal. By means of means 82 for performing an inverse integer MDCT (IntMDCT), the output signal of the combiner 78 is also converted to its temporal representation, in order to generate a losslessly coded/decoded audio signal or, when a corresponding rougher rounding has been employed, an almost losslessly coded and again decoded audio signal.

In the following, it is gone into a special preferred embodiment of the entropy coder 60*b* of FIG. 6. Since, in a usual modern MPEG coder, several code tables selected depending on average statistics of the quantized spectral values are present, it is preferred to use the same code tables or code books also for the entropy coding of the difference block at the output of the combiner 58. Since the magnitude of the difference block, i.e. of the residual IntMDCT spectrum, depends on the accuracy of the quantization, a codebook selection of the entropy coder 60*b* may be performed without ancillary side information.

In a MPEG-2 AAC coder, the spectral coefficients, i.e. the quantized spectral values, are grouped into scale factor bands in the quantization block, wherein the spectral values are weighted with a gain factor derived from a corresponding scale factor associated with a scale factor band. Since in this known coder concept a non-uniform quantizer is used to quantize the weighted spectral values, the size of the residual values, i.e. the spectral values at the output of the combiner 58, does not only depend on the scale factors but also on the quantized values themselves. But since both the scale factors and the quantized spectral values are contained in the bit stream, which is generated by the means 60*a* of FIG. 6, i.e. in the psychoacoustically coded audio data, it is preferred to perform a codebook selection in the coder depending on the size of the difference spectral values and also to ascertain, in the decoder, the code table used in the coder on the basis of both the scale factors transmitted in the bit stream and the quantized values. Since no side information has to be transmitted for entropy coding the difference spectral values at the output of the combiner 58, the entropy coding only leads to data rate compression, without having to expend any signalization bits in the data stream as side information for the entropy coder 60*b*.

Figure 1:
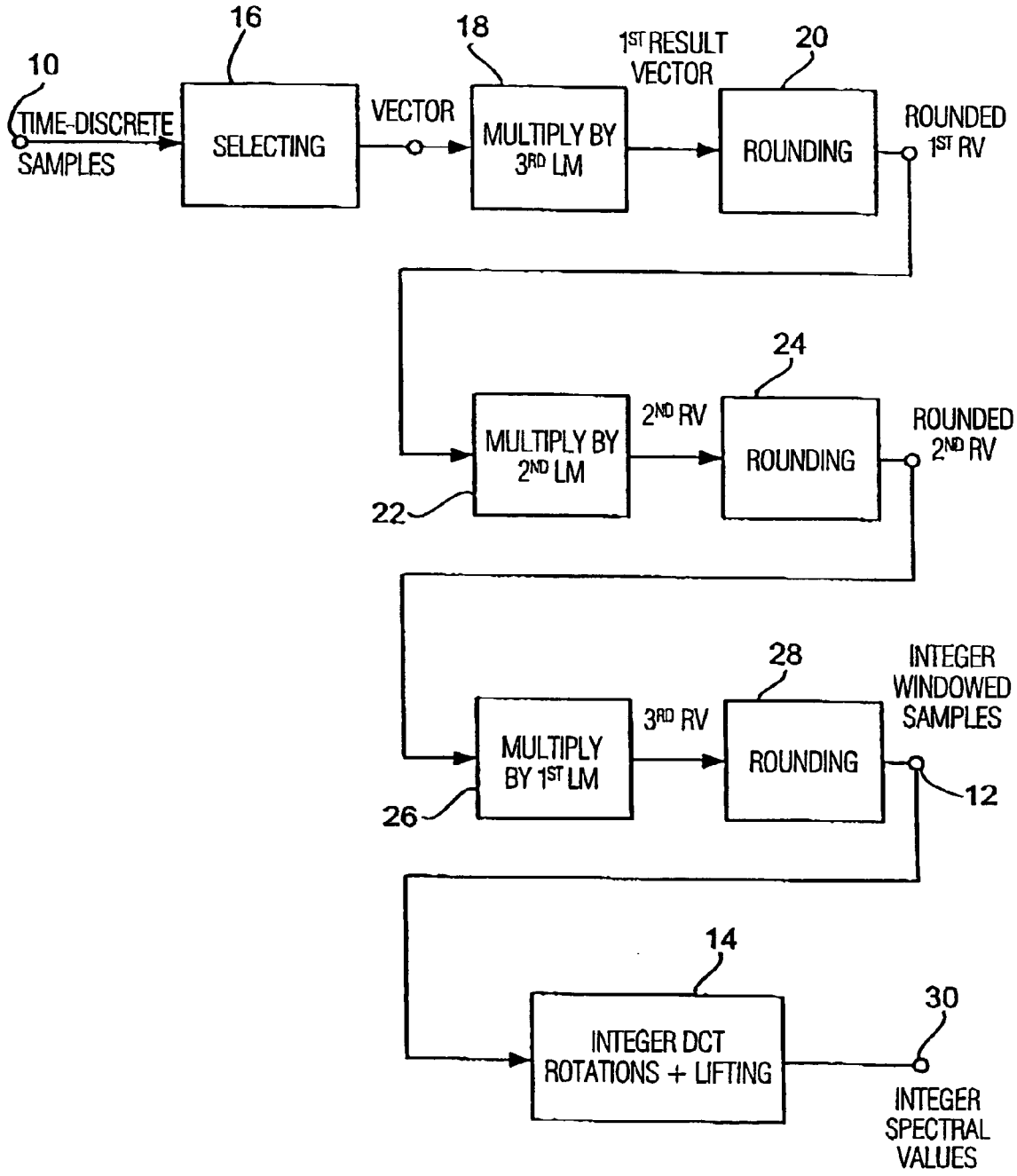
FIG. 1 is a block circuit diagram of preferred means for processing time-discrete audio samples to obtain integer values from which integer spectral values can be ascertained.
Figure 2:
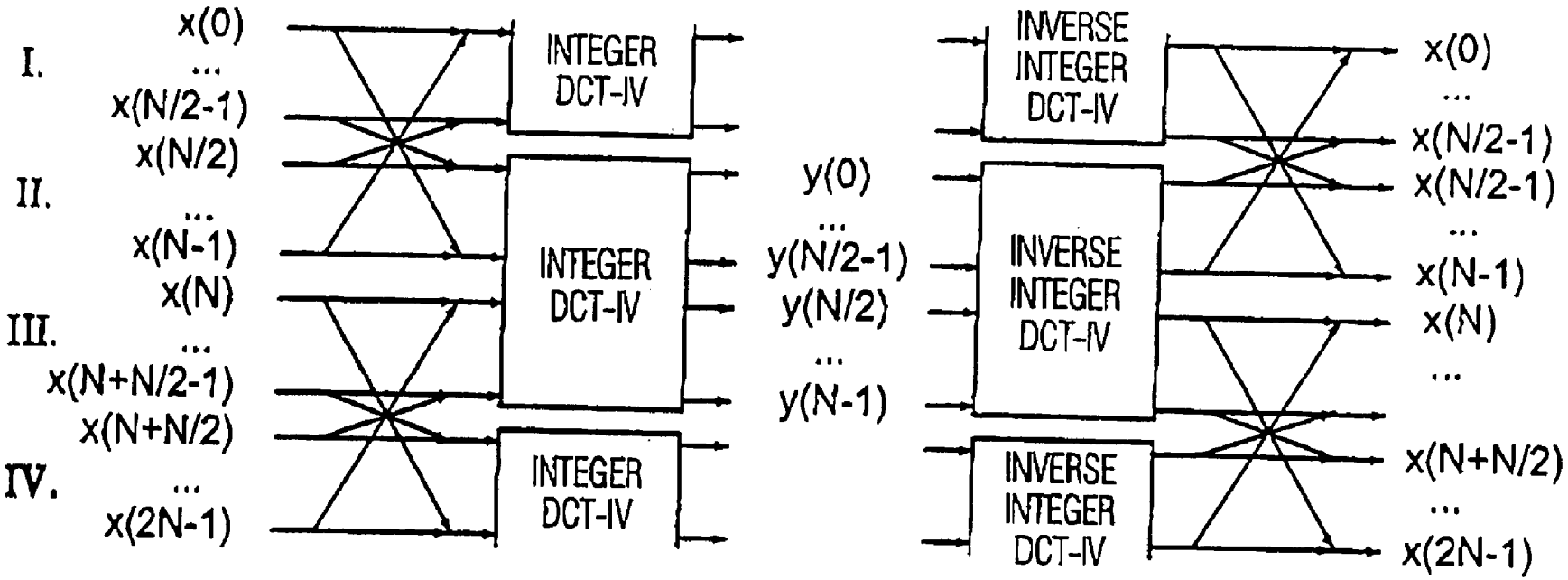
FIG. 2 is a schematic illustration of the split-up of a MDCT and an inverse MDCT in Givens rotations and two DCT-IV operations.
Figure 3:
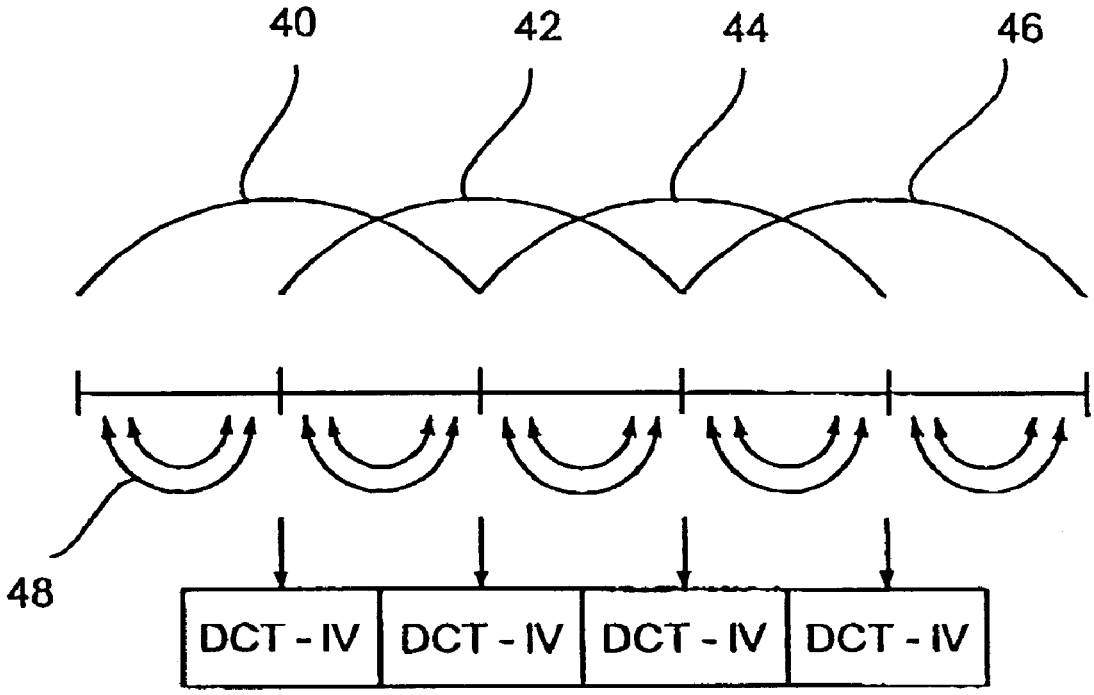
FIG. 3 is a representation for the illustration of the split-up of the MDCT with 50% overlap in rotations and DCT-IV operations.
Figure 4A:
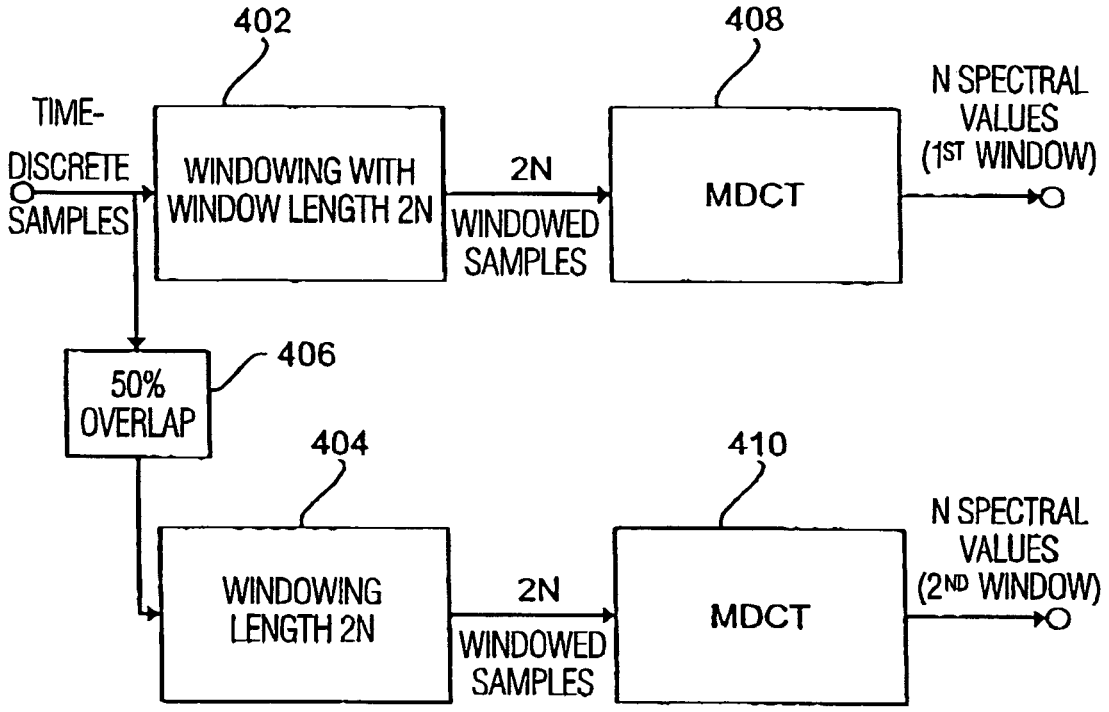
FIG. 4*a* is a schematic block circuit diagram of a known coder with MDCT and 50 percent overlap.
Figure 4B:
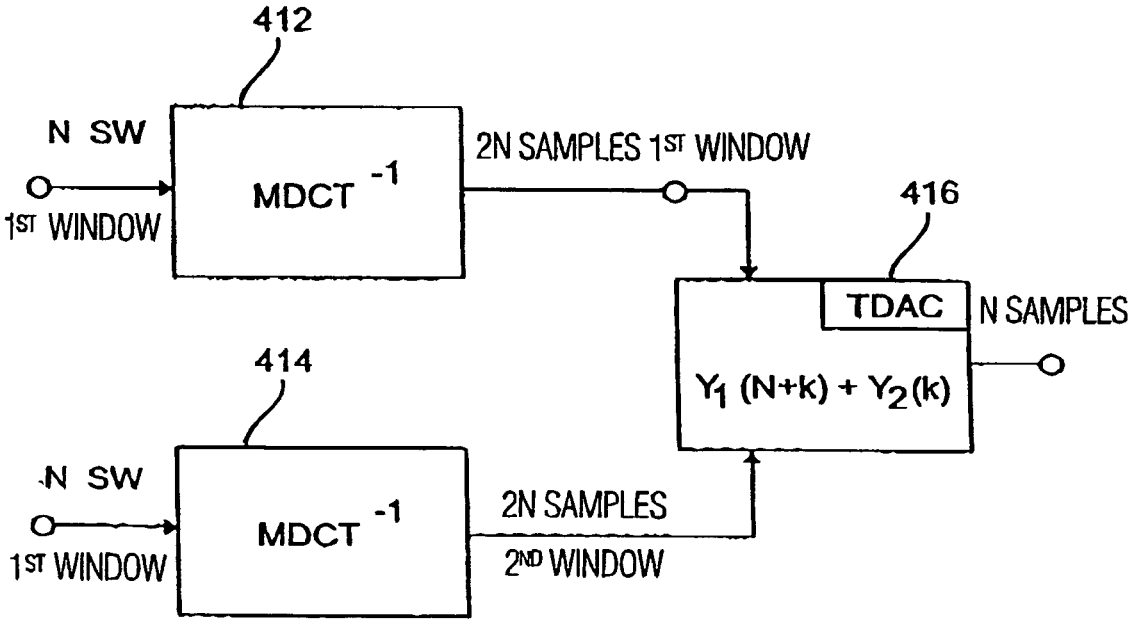
FIG. 4*b* is a block circuit diagram of a known decoder for decoding the values generated by FIG. 4*a;*

In an audio coder according to the standard MPEG-2 AAC, window switching is used to avoid pre-echoes in transient audio signal areas. This technique is based on the possibility to select window shapes individually in each half of the MDCT window, and enables to vary the block size in successive blocks. Similarly, the integer transform algorithm in form of the IntMDCT, which is explained with reference to FIGS. 1 to 3, is executed to also use different window shapes in windowing and in the time domain aliasing section of the MDCT split-up. It is thus preferred to use the same window decisions both for the integer transform algorithm and for the transform algorithm for generating the quantization block.

In a coder according to MPEG-2 AAC, also several further coding tools exist, of which only TNS (temporal noise shaping) and center/side (CS) stereo coding are to be mentioned. In TNS coding, just like in CS coding, modification of the spectral values prior to the quantization is performed. Consequently, the difference between the IntMDCT values, i.e. the integer block, and the quantized MDCT values increases. According to the invention, the integer transform algorithm is formed to admit both TNS coding and center/side coding also of integer spectral values. The TNS technique is based on adaptive forward prediction of the MDCT values over the frequency. The same prediction filter calculated by a usual TNS module in a signal-adaptive manner is preferably also used to predict the integer spectral values, wherein, if non-integer values arise thereby, downstream rounding may be employed, in order to again generate integer values. This rounding preferably takes place after each prediction step. In the decoder, the original spectrum may again be reconstructed by employing the inverse filter and the same rounding function. Similarly, the CS coding may also be applied to IntMDCT spectral values by applying rounded Givens rotations with an angle of $\pi/4$, based on the lifting scheme. Thereby, the original IntMDCT values in the decoder may be reconstructed again.

It is to be noted that the inventive concept in its preferred embodiment with the IntMDCT as integer transform algorithm may be applied to all MDCT-based hearing-adapted audio coders. Only as an example, such coders are coders according to MPEG-4 AAC Scalable, MPEG-4 AAC Low Delay, MPEG-4 BSAC, MPEG-4 Twin VQ, Dolby AC-3 etc.

In particular, it is to be noted that the inventive concept is reversely compatible. The hearing-adapted coder or decoder is not changed, but only extended. Ancillary information for the lossless components may be transmitted in the bit stream coded in a hearing-adapted manner in a reversely compatible manner, such as in MPEG-2 AAC in the field "Ancillary Data". The addition to the previous hearing-adapted decoder drawn in a dashed manner in FIG. 7 may evaluate this ancillary data, and reconstruct, together with the quantized MDCT spectrum, the IntMDCT spectrum in a lossless manner from the hearing-adapted decoder.

The inventive concept of the psychoacoustic coding, supplemented by lossless or almost lossless coding, is particularly suited for the generation, transmission, and decoding of scalable data streams. It is known that scalable data streams include various scaling layers, at least the lowest scaling layer of which may be transmitted and decoded independently of the higher scaling layers. Further scaling layers or enhancement layers are added to the first scaling layer or base layer in a scalable processing of data. A fully equipped coder may generate a scalable data stream having a first scaling layer and in principle having an arbitrary number of further scaling layers. An advantage of the scaling concept is that, in the case in which a broadband transmission channel is available, the scaled data stream generated by the coder may be transmitted completely, i.e. inclusive of all scaling layers, via the broadband transmission channel.

If, however, only a narrowband transmission channel is present, the coded signal may yet be transmitted via the transmission channel, but only in form of the first scaling layer or a certain number of further scaling layers, wherein the certain number is smaller than the overall number of scaling layers generated by the coder. Of course, the coder, adapted to a channel to which it is connected, may already generate the base scaling layer or first scaling layer and a number of further scaling layers dependent on the channel.

On the decoder side, the scalable concept also has the advantage that it is reversely compatible. This means that a decoder that is only able to process the first scaling layer simply ignores the second and further scaling layers in the data stream and can generate a useful output signal. If, however, the decoder is a typically more modern decoder that is able to process several scaling layers from the scaled data stream, this coder may be addressed with the same data stream as a base decoder.

In the present invention, the basic scalability is that the quantization block, i.e. the output of the bit stream coder 60*a*, is written to a first scaling layer 81 of FIG. 8, which, when FIG. 6 is considered, includes psychoacoustically coded data e.g. for a frame. The preferably entropy-coded difference spectral values generated by the combining means 58 are written into the second scaling layer at simple scalability, which is designated with 82 in FIG. 8*a* and thus includes the ancilliary audio data for a frame.

If the transmission channel from the coder to the decoder is a broadband transmission channel, both scaling layers 81 and 82 may be transmitted to the decoder. If, however, the transmission channel is a narrowband transmission channel, in which only the first scaling layer "fits", the second scaling layer may simply be removed from the data stream before the transmission, so that a decoder is only addressed with the first scaling layer.

On the decoder side a "base decoder" that is only able to process the psychoacoustically coded data may simply omit the second scaling layer 82, as far it has received it via a broadband transmission channel. If, however, the decoder is a fully equipped decoder including both a psychoacoustic decoding algorithm and an integer decoding algorithm, this fully equipped decoder may take both the first scaling layer and the second scaling layer for decoding to generate a losslessly coded and again decoded output signal.

In a preferred embodiment of the present invention, as it is schematically illustrated in FIG. 8*a*, the psychoacoustically coded data for a frame will again be in a first scaling layer. The second scaling layer of FIG. 8*a*, however, is now scaled more finely, so that from this second scaling layer in FIG. 8*a* several scaling layers arise, such as a (smaller) second scaling layer, a third scaling layer, a fourth scaling layer, etc.

The difference spectral values output from the adder 58 are particularly well suited for further subscaling, as it is illustrated on the basis of FIG. 9. FIG. 9 schematically illustrates binarily coded spectral values. Each row 90 in FIG. 9 represents a binarily coded difference spectral value. In FIG. 9 the difference spectral values are sorted according to the frequency, as it is implied by an arrow 91. A difference spectral value 92 thus has a higher frequency than the difference spectral value 90. The first column of the tablet in FIG. 9 presents the most significant bit of a difference spectral value. The second digit represents the bit with a significance MSB−1. The third column represents a bit with the significance MSB−2. The last but second column represents a bit with the significance LSB+2. The last but one column represents a bit with the significance LSB+1. Finally, the last column represents a bit with the significance LSB, i.e. the least significant bit of a difference spectral value.

In a preferred embodiment of the present invention, an accuracy scaling is made in that the e.g. 16 most significant bits of a difference spectral value are taken as second scaling layer, in order to then, if desired, be entropy coded by the entropy coder 60*b*. A decoder using the second scaling layer obtains difference spectral values with an accuracy of 16 bits at the output side, so that the second scaling layer, together with the first scaling layer, provides a losslessly decoded audio signal in CD quality. It is known that audio samples in CD quality with a width of 16 bits are present.

If on the other hand an audio signal in studio quality is fed to the coder, i.e. an audio signal with samples, with each sample including 24 bits, the coder may further generate a third scaling layer including the last eight bits of a difference spectral value and also being entropy coded depending on demand (means 60 of FIG. 6).

A fully equipped decoder obtaining the data stream with the first scaling layer, the second scaling layer (16 most significant bits of the difference spectral values), and the third scaling layer (8 less significant bits of a difference spectral value) may provide a losslessly coded/decoded audio signal in studio quality, i.e. with a word width of a sample of 24 bits present at the output of the decoder, using all three scaling layers.

It is to be noted that in the studio area higher word lengths of the samples are customary than in the consumer area. In the consumer area the word width is 16 bits in an audio CD, whereas in the studio area 24 bits or 20 bits are employed.

Based on the concept of the scaling in the IntMDCT area, as it has been set forth, thus all three accuracies (16 bits, 20 bits or 24 bits) or arbitrary accuracies scaled by minimally 1 bit may be scalably coded.

Here, the audio signal represented with 24 bit accuracy is represented in the integer spectral region with the aid of the inverse IntMDCT and scalably combined with a hearing-adapted MDCT-based audiocoder output signal.

The integer difference values present for the lossless representation are now not completely coded in a scaling layer, but at first with lower accuracy. Only in a further scaling layer are the residual values transmitted that necessary for the exact representation. Alternatively however, a difference spectral value could be represented entirely, i.e. with for example 24 bits, also in a further scaling layer, so that for decoding this further scaling layer the underlying scaling layer is not required. This scenario, however, altogether leads to a higher bit stream size, but when the bandwidth of the transmission channel is unproblematic may contribute to a simplification in the decoder, since in the decoder scaling layers do then no longer have to be combined, but always one scaling layer alone is sufficient for decoding.

If for example the lower eight LSB, as it is illustrated in FIG. 9, are not transmitted at first, a scalability between 24 bits and 16 bits is achieved.

For the inverse transform of the values transmitted with lower accuracy into the time domain, the transmitted values are preferably scaled back to the original region, for example 24 bits, by multiplying them for example by $2^8$. An inverse IntMDCT is then applied to the correspondingly scaled-back values.

In the inventive accuracy scaling in the frequency domain, it is further preferred to also utilize the redundancy in the LSBs. If an audio signal for example has very little energy in the upper frequency domain, this also shows in very small values in the IntMDCT spectrum, which are for example significantly smaller than values (−128, . . . , 127) possible with for example 8 bits. This shows in a compressibility of the LSB values of the IntMDCT spectrum. Furthermore, it is to be noted that in very small difference spectral values typically a number of bits from MSB to MSB−1 are equal to zero, and that then the first, leading 1 in a binarily coded difference spectral value does not occur before a bit with a significance MSB−n−1. In such a case, when a difference spectral value in the second scaling layer includes only zeros, entropy coding is particularly well suited for the further data compression.

According to a further embodiment of the present invention, for the second scaling layer 82 of FIG. 8*a*, a sample rate scalability is preferred. A sample rate scalability is achieved by the difference spectral values up to a first cut-off frequency being contained in the second scaling layer, as it is illustrated in FIG. 9 on the right, whereas in a further scaling layer the difference spectral values with a frequency between the first cut-off frequency and the maximum frequency are contained. Of course, further scaling may be performed, so that several scaling layers are made from the entire frequency domain.

In a preferred embodiment of the present invention, the second scaling layer in FIG. 9 includes difference spectral values up to a frequency of 24 kHz, corresponding to a sample rate of 48 kHz. The third scaling layer then contains the difference spectral values from 24 kHz to 48 kHz, corresponding to a sample rate of 96 kHz.

It is further to be noted that in the second scaling layer and the third scaling layer not necessarily all bits of a difference spectral value have to be coded. In a further form of the combined scalability, the second scaling layer could include bits MSB to MSB-X of the difference spectral values up to a certain cut-off frequency. A third scaling layer could then include the bits MSB to MSB-X of the difference spectral values from the first cut-off frequency to the maximum frequency. A fourth scaling layer could then include the residual bits for the difference spectral values up to the cut-off frequency. The last scaling layer could then include the residual bits of the difference spectral values for the upper frequencies. This concept will lead to a division of the tablet in FIG. 9 into four quadrants, each quadrant representing a scaling layer.

In the scalability in frequency, in a preferred embodiment of the present invention, a scalability between 48 kHz and 96 kHz sample rate is described. The 96 kHz sample signal is at first only coded half in the IntMDCT area in the lossless extension layer and transmitted. If the upper part is not transmitted in addition, it is assumed zero in the decoder. In the inverse IntMDCT (same length as in the coder), then a 96 kHz signal arises, which does not contain energy in the upper frequency domain and may thus be subsampled on 48 kHz without quality losses.

The above scaling of the difference spectral values in quadrants of FIG. 9 with fixed boundaries is favorable regarding the size of the scaling layers, because in a scaling layer in fact only e.g. 16 bits or 8 bits or the spectral values up to the cut-off frequency or above the cut-off frequency have to be contained.

An alternative scaling is to somewhat "soften" the quadrant boundaries in FIG. 9. In the example of the frequency scalability this would mean not to apply a so-called "brick-wall low pass" in that the difference spectral values before a cut-off frequency are unchanged and are zero after the cut-off frequency. Instead, the difference spectral values could also be filtered with an arbitrary low pass already somewhat impeding the spectral values below the cut-off frequency, but, above the cut-off frequency, leading to here also still being energy, although the difference spectral values are decreasing in energy. In a so-generated scaling layer, then also spectral values above the cut-off frequency are contained. Since these spectral values, however, are relatively small, they are efficiently codable by entropy coding. The highest scaling layer would in this case have the difference between the complete difference spectral values and the spectral values contained in the second scaling layer.

The accuracy scaling may also somewhat be softened similarly. The first scaling layer may also have spectral values with e.g. more than 16 bits, wherein the next scaling layer then still has the difference. Generally speaking, the second scaling layer thus has the difference spectral values with lower accuracy, whereas in the next scaling layer the rest, i.e. the difference between the complete spectral values and the spectral values contained in the second scaling layer, is transmitted. With this, variable accuracy reduction is achieved.

The inventive method for coding or decoding is preferably stored on a digital storage medium, such as a floppy disc, with electronically readable control signals, wherein the control signals may cooperate with a programmable computer system so that the coding and/or decoding method may be executed. In other words, a computer program product with a program code stored on a machine-readable carrier for performing the coding method and/or the decoding method is present, when the program product is executed on a computer. The inventive method may be realized in a computer program with a program code for performing the inventive methods, when the program is executed on a computer.

In the following, as an example for an integer transform algorithm, it is gone into the IntMDCT transform algorithm described in "Audio Coding Based on Integer Transforms" $111^{th}$ AES convention, New York, 2001. The IntMDCT is particularly favorable, since it has the attractive properties of the MDCT, such as good spectral representation of the audio signal, critical sampling, and block overlap. A good approximation of the MDCT by an IntMDCT also enables to use only one transform algorithm in the coder shown in FIG. 5, as it is illustrated by an arrow 62 in FIG. 5. On the basis of FIGS. 1 to 4, the substantial properties of this special form of an integer transform algorithm are explained.

FIG. 1 shows an overview diagram for the inventively preferred apparatus for processing time-discrete samples representing an audio signal, in order to obtain integer values based on which the Int-MDCT integer transform algorithm works. The time-discrete samples are windowed and optionally converted to a spectral representation by the apparatus shown in FIG. 1. The time-discrete samples fed to the apparatus at an input 10 are windowed with a window w with a length corresponding to 2N time-discrete samples, to achieve integer windowed samples at an output 12, which are suited to be converted to a spectral representation by means of a transform and in particular the means 14 for executing an integer DCT. The integer DCT is formed to generate N output values from N input values, which is in contrast to the MDCT function 408 of FIG. 4*a*, which only generates N spectral values from 2N windowed samples due to the MDCT equation.

For windowing the time-discrete samples, at first two time-discrete samples are selected in means 16, which together represent a vector of time-discrete samples. A time-discrete sample selected by means 16 lies in the first quarter of the window. The other time-discrete sample lies in the second quarter of the window, as it is explained in still greater detail on the basis of FIG. 3. To the vector generated by means 16 is now a rotation matrix of the dimension 2×2 is applied, wherein this operation is not performed immediately, but by means of several so-called lifting matrices.

A lifting matrix has the property of only comprising one element dependent on the window w and being unequal "1" or "0".

The factorization of wavelet transforms into lifting steps is illustrated in the publication "Factoring Wavelet Transforms Into Lifting Steps", Ingrid Daubechies and Wim Sweldens, preprint, Bell Laboratories, Ludent Technologies, 1996. In general, a lifting scheme is a simple relation between perfectly reconstructed filter pairs having the same low-pass or high-pass filter. Each pair of complementary filters may be factorized into lifting steps. This applies in particular to Givens rotations. Consider the case in which the poly-phase matrix is a Givens rotation. Then, the following applies:

$$\begin{pmatrix} \cos\alpha & -\sin\alpha \\ \sin\alpha & \cos\alpha \end{pmatrix} = \begin{pmatrix} 1 & \frac{\cos\alpha - 1}{\sin\alpha} \\ 0 & 1 \end{pmatrix} \begin{pmatrix} 1 & 0 \\ \sin\alpha & 1 \end{pmatrix} \begin{pmatrix} 1 & \frac{\cos\alpha - 1}{\sin\alpha} \\ 0 & 1 \end{pmatrix} \tag{1}$$

Each of the three lifting matrices to the right of the equality sign has the value "1" as main diagonal elements. Furthermore, in each lifting matrix an element not on the main diagonal equals 0, and an element not on the main diagonal is dependent on the rotation angle α.

The vector is now multiplied by the third lifting matrix, i.e. the lifting matrix on the far right in the above equation, to obtain a first result vector. This is illustrated in FIG. 1 by means 18. Now the first result vector is rounded with an arbitrary rounding function mapping the set of real numbers to the set of integers, as it is illustrated in FIG. 1 by means 20. At the output of means 20, a rounded first result vector is obtained. The rounded first result vector is now fed to means 22 for multiplying it by the center, i.e. second, lifting matrix, to obtain a second result vector, which is again rounded in means 24, to obtain a rounded second result vector. The rounded second result vector is now fed to means 26 for multiplying it by the lifting matrix set forth on the left in the above equation, i.e. the first one, to obtain a third result vector which is in the end still rounded by means of means 28 to obtain integer windowed samples in the end at the output 12, which now, when a spectral representation thereof is desired, have to be processed by means 14 to obtain integer spectral values at a spectral output 30.

Preferably, means 14 is embodied as integer DCT.

The discrete cosine transform according to type 4 (DCT-IV) with a length N is given by the following equation:

$$X_t(m) = \sqrt{\frac{2}{N}} \sum_{k=0}^{N-1} x(k) \cos\left(\frac{\pi}{4N}(2k+1)(2m+1)\right) \tag{2}$$

The coefficients of the DCT-IV form an orthonormal N×N matrix. Each orthogonal N×N matrix may be split up into N (N−1)/2 Givens rotations, as it is explained in the publication P. P. Vaidyanathan, "Multirate Systems And Filter Banks", Prentice Hall, Englewood Cliffs, 1993. It is to be noted that there are also further split-ups.

With reference to the classifications of the various DCT algorithms, reference is to be made to H. S. Malvar, "Signal Processing With Lapped Transforms", Artech House, 1992. In general, the DCT algorithms differ by the kind of their basis functions. While the DCT-IV, which is preferred here, includes non-symmetrical basis functions, i.e. a cosine quarter wave, a cosine ¾ wave, a cosine ⁵⁄₄ wave, a cosine ⁷⁄₄ wave, etc., the discrete cosine transform e.g. of the type II (DCT-II) has axis-symmetrical and point-symmetrical basis functions. The $0^{th}$ basis function has a DC component, the first basis function is half a cosine wave, the second basis function is a whole cosine wave, etc. Due to the fact that the DCT-II particularly takes the DC component into account, it is used in the video coding, but not in the audio coding, since in the audio coding in contrast to the video coding the DC component is irrelevant.

In the following, it is gone into how the rotation angle α of the Givens rotation depends on the window function.

A MDCT with a window length of 2N may be reduced to a discrete cosine transform of type IV with a length N. This is achieved by the TDAC operation being performed explicitly in the time domain and the DCT-IV then being applied. With a 50% overlap, the left half of the window for a block t overlaps with the right half of the preceding block, i.e. the block t-1. The overlapping part of two successive blocks t-1 and t is preprocessed in the time domain, i.e. before the transform, i.e. between the input 10 and the output 12 of FIG. 1, as follows:

$$\begin{pmatrix} \tilde{x}_t(k) \\ \tilde{x}_{t-1}(N-1-k) \end{pmatrix} = \begin{pmatrix} w\left(\frac{N}{2}+k\right) & -w\left(\frac{N}{2}-1-k\right) \\ w\left(\frac{N}{2}-1-k\right) & w\left(\frac{N}{2}+k\right) \end{pmatrix} \begin{pmatrix} x_t\left(\frac{N}{2}+k\right) \\ x_t\left(\frac{N}{2}-1-k\right) \end{pmatrix} \tag{3}$$

The values designated with the tilde are the values at the output 12 of FIG. 1, whereas x values designated without tilde in the above equation are the values at the input 10 or behind the means 16 for selecting. The running index k runs from 0 to N/2−1, while w represents the window function.

From the TDAC condition for the window function w, the following connection applies:

$$w\left(\frac{N}{2}+k\right)^2 + w\left(\frac{N}{2}-1-k\right)^2 = 1 \tag{4}$$

For certain angles $\alpha_k$, k=0, . . . , N/2−1, this preprocessing in the time domain may be written as Givens rotation, as it has been explained.

The angle α of the Givens rotation depends on the window function w as follows:

$$\alpha = \arctan\left[w(N/2-1-k)/w(N/2+k)\right] \tag{5}$$

It is to be noted that arbitrary window functions w may be employed as long as they meet this TDAC condition.

In the following, on the basis of FIG. 2, a cascaded coder and decoder is described. The time-discrete samples x(0) to x(2N−1) "windowed" together by a window are at first selected by means 16 of FIG. 1 such that the sample x(0) and the sample x(N−1), i.e. a sample from the first quarter of the window and a sample from the second quarter of the window, are selected to form the vector at the output of means 16. The crossing arrows schematically illustrate the lifting multiplications and ensuing roundings of means 18, 20 or 22, 24 or 26, 28, in order to obtain the integer windowed samples at the input of the DCT-IV blocks.

When the first vector is processed as described above, also a second vector is selected from the samples x(N/2−1) and x(N/2), i.e. again a sample from the first quarter of the window and a sample from the second quarter of the window, and again processed by the algorithm described in FIG. 1. In analogy therewith, all other sample pairs from the first and second quarters of the window are treated. The same processing is performed for the third and fourth quarters of the first window. At the output 12, now N windowed integer samples are present, which are now fed to a DCT-IV transform, as it is illustrated in FIG. 2. In particular, the integer windowed samples of the second and third quarters are fed to a DCT. The windowed integer samples of the first quarter of the window are processed, together with the windowed integer samples of the fourth quarter of the preceding window, into a preceding DCT-IV. In analogy therewith, the fourth quarter of the windowed integer samples in FIG. 2, together with the first quarter of the next window, is fed to a DCT-IV transform. The center integer DCT-IV transform 32 shown in FIG. 2 now provides N integer spectral values y(0) to y(N−1). These integer spectral values may now for example simply be entropy coded, without an intervening quantization being required, since the windowing and transform provide integer output values.

In the right half of FIG. 2, a decoder is illustrated. The decoder including inverse transform and "inverse windowing" works inversely to the coder. It is known that for the inverse transform of a DCT-IV, an inverse DCT-IV may be used, as it is illustrated in FIG. 2. The output values of the decoder DCT-IV 34 are now, as it is illustrated in FIG. 2, inversely processed with the corresponding values of the preceding transform or the following transform, in order to generate again time-discrete audio samples x(0) to x(2N−1) from the integer windowed samples at the output of means 34 or the preceding and following transform.

The output-side operation takes place by an inverse Givens rotation, i.e. such that the blocks 26, 28 or 22, 24 or 18, 20 are passed in the opposite direction. This is to be illustrated in greater detail on the basis of the second lifting matrix of equation 1. When (in the coder) the second result vector is formed by multiplication of the rounded first result vector by the second lifting matrix (means 22), the following term results:

$$(x,y)\rightarrow(x,y+x\sin\alpha) \tag{6}$$

The values x, y on the right side of equation 6 are integers. This however does not apply for the value x sin α. Here, the rounding function r has to be introduced, as it is illustrated in the following equation.

$$(x,y)\rightarrow(x,y+r(x\sin\alpha)) \tag{7}$$

This operation executes means 24.

The inverse mapping (in the decoder) is defined as follows:

$$(x',y')\rightarrow(x',y'-r(x'\sin\alpha)) \tag{8}$$

Due to the minus sign in front of the rounding operation, it becomes apparent that the integer approximation of the lifting step may be reversed, without introducing an error. The application of this approximation to each of the three lifting steps leads to an integer approximation of the Givens rotation. The rounded rotation (in the coder) may be reversed (in the decoder), without introducing an error, namely by passing the inverse rounded lifting steps in reversed order, i.e. when in decoding the algorithm of FIG. 1 is performed from bottom to top.

If the rounding function r is point-symmetrical, the inversed rounded rotation is identical to the rounded rotation with the angle −α, and reads as follows:

$$\begin{pmatrix} \cos\alpha & \sin\alpha \\ -\sin\alpha & \cos\alpha \end{pmatrix} \tag{9}$$

The lifting matrices for the decoder, i.e. for the inverse Givens rotation, in this case immediately result from equation (1), by simply replacing the term "sin α" by the term "−sin α".

In the following, on the basis of FIG. 3, the split-up of a usual MDCT with overlapping windows 40 to 46 is set forth once again. The windows 40 to 46 each overlap 50%. Per window, at first Givens rotations within the first and second quarters of a window or within the third and fourth quarters of a window are executed, as it is schematically illustrated by the arrows 48. Then, the rotated values, i.e. the windowed integer samples, are fed to an N-to-N DCT such that always the second and third quarters of a window or the fourth and first quarters of a successive window are together converted to a spectral representation by means of a DCT-IV algorithm.

Therefore, the usual Givens rotations are split up into lifting matrices, which are executed sequentially, wherein after each lifting matrix multiplication a rounding step is introduced such that the floating-point numbers are rounded immediately after their development such that before each multiplication of a result vector by a lifting matrix the result vector has only integers.

The output values always stay integer, it being preferred to also use integer input values. This does not represent a limitation, since any exemplary PCM samples, as they are stored on a CD, are integer number values the value range of which varies depending on bit width, i.e. depending on whether the time-discrete digital input values are 16-bit values or 24-bit values. Nevertheless, as it has been set forth, the entire process is invertible by executing the inverse rotations in reversed order. Thus, an integer approximation of the MDCT with perfect reconstruction exists, namely a lossless transform.

The transform shown provides integer output values instead of floating-point values. It provides a perfect reconstruction, so that no error is introduced when a forward and then a backward transform are executed. The transform, according to a preferred embodiment of the present invention, is a replacement for the modified discrete cosine transform. Other transform methods may, however, also be executed in an integer manner, as long as a split-up into rotations and a split-up of the rotations into lifting steps is possible.

The integer MDCT has most of the favorable properties of the MDCT. It has an overlapping structure, whereby better frequency selectivity than in non-overlapping block transforms is obtained. Due to the TDAC function, which is already taken into account when windowing prior to the transform, critical sampling is maintained so that the overall number of spectral values representing an audio signal equals the overall number of input samples.

Compared with a normal MDCT providing floating-point samples, in the described preferred integer transform, it shows that only in the spectral region in which there is little signal level the noise is increased in comparison with the normal MDCT, whereas this noise increase does not make itself felt at significant signal levels. For this, the integer processing lends itself for an efficient hardware implementation, since only multiplication steps are used, which may easily be split up into shift/add steps, which may be implemented in hardware easily and quickly. Of course, a software implementation is also possible.

The integer transform provides a good spectral representation of the audio signal and yet remains in the area of integers. When it is applied to tonal parts of an audio signal, this results in good energy concentration. With this, an efficient lossless coding scheme may be built up by simply cascading the windowing/transform illustrated in FIG. 1 with an entropy coder. In particular, stacked coding using escape values, as it is employed in MPEG AAC, is favorable. It is preferred to scale down all values by a certain power of two until they fit in a desired code table, and then code the omitted least significant bits in addition. In comparison with the alternative of the use of larger code tables, the alternative described is more favorable with regard to the storage consumption for storing the code tables. An almost lossless coder could also be obtained by simply omitting certain of the least significant bits.

In particular for tonal signals, entropy coding of the integer spectral values enables high coding gain. For transient parts of the signal, the coding gain is low, namely due to the flat spectrum of transient signals, i.e. due to a small number of spectral values equal to or almost 0. As it is described in J. Herre, J. D. Johnston: "Enhancing the Performance of Perceptual Audio Coders by Using Temporal Noise Shaping (TNS)" 101$^{st}$ AES Convention, Los Angeles, 1996, preprint 4384, this flatness may however be used by using a linear prediction in the frequency domain. An alternative is a prediction with open loop. Another alternative is the predictor with closed loop. The first alternative, i.e. the predictor with open loop, is called TNS. The quantization after the prediction leads to adaptation of the resulting quantization noise to the temporal structure of the audio signal and thus prevents pre-echoes in psychoacoustic audio coders. For lossless audio coding, the second alternative, i.e. with a predictor with closed loop, is more suited, since the prediction with closed loop allows accurate reconstruction of the input signal. When this technique is applied to a generated spectrum, a rounding step has to be performed after each step of the prediction filter in order to stay in the area of the integers. By using the inverse filter and the same rounding function, the original spectrum may accurately be produced.

In order to take advantage of the redundancy between two channels for data reduction, also center-side coding may be employed in a lossless manner, when a rounded rotation with an angle $\alpha/4$ is used. In comparison with the alternative of calculating the sum and difference of the left and right channel of a stereo signal, the rounded rotations have the advantage of the energy maintenance. The use of so-called joint stereo coding techniques may be switched on or off for each band, as it is also performed in the standard MPEG AAC. Further rotation angles may also be taken into account to be able to reduce redundancy between two channels more flexibly.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for coding a time-discrete audio signal to obtain coded audio data, comprising:

a quantizer for providing a quantization block of spectral values of the time-discrete audio signal quantized using a psychoacoustic model;

an inverse quantizer for inversely quantizing the quantization block and for rounding the inversely quantized spectral values to obtain a rounding block of rounded inversely quantized spectral values;

a generator for generating an integer block of integer spectral values using an integer transform algorithm formed to generate the integer block of spectral values from a block of integer time-discrete samples;

a combiner for forming a difference block depending on a spectral value-wise difference between the rounding block and the integer block, to obtain a difference block with difference spectral values; and a processor for processing the quantization block and the difference block to generate coded audio data including information on the quantization block and information on the difference block.

2. The apparatus of claim 1, wherein the quantizer is formed to calculate the quantization block using a floating-point transform algorithm.

3. The apparatus of claim 1, wherein the quantizer is formed to calculate the quantization block using the integer block generated by the generator.

4. The apparatus of claim 1, wherein the quantizer is formed to use one of a plurality of windows for windowing a temporal block of audio signal values depending on a property of the audio signal, and wherein the generator is formed to make the same window selection for the integer transform algorithm.

5. The apparatus of claim 1, wherein the generator is formed to use an integer transform algorithm, comprising:

windowing the time-discrete samples with a window with a length corresponding to 2N time-discrete samples, to provide windowed time-discrete samples for a conversion of the time-discrete samples to a spectral representation by means of a transform capable of generating N output values from N input values, wherein the windowing comprises the following substeps:

selecting a time-discrete sample from a quarter of the window and a time-discrete sample from another quarter of the window to obtain a vector of time-discrete samples;

applying a square rotation matrix the dimension of which matches the dimension of the vector to the vector, wherein the rotation matrix is representable by a plurality of lifting matrices, wherein a lifting matrix only comprises one element dependent on the window and being unequal to 1 or 0, wherein the substep of applying comprises the following substeps:

multiplying the vector by a lifting matrix to obtain a first result vector;

rounding a component of the first result vector with a rounding function mapping a real number to an integer to obtain a rounded first result vector; and sequentially performing the steps of multiplying and rounding with another lifting matrix, until all lifting matrices are processed, to obtain a rotated vector comprising an integer windowed sample from the quarter of the window and an integer windowed sample from the other quarter of the window, and performing the step of windowing for all time-discrete samples of the remaining quarters of the window to obtain 2N filtered integer values; and converting N windowed integer samples to a spectral representation by an integer DCT for values with the filtered integer samples of the second quarter and the third quarter of the window, to obtain N integer spectral values.

6. The apparatus of claim 1, wherein the quantizer for providing the quantization block is formed to perform a prediction of spectral values over the frequency using a prediction filter prior to a quantization step, to obtain prediction residual spectral values representing the quantization block after a quantization;

wherein also a predictor is provided, which is formed to perform a prediction over the frequency of the integer spectral values of the integer block, wherein also a rounder is provided to round prediction residual spectral values due to the integer spectral values representing the rounding block.

7. The apparatus of claim 1, wherein the time-discrete audio signal comprises at least two channels, wherein the quantizer is formed to perform center/side coding with spectral values of the time-discrete audio signal to obtain the quantization block after quantization of center/side spectral values, and wherein the generator for generating the integer block is formed to also perform center/side coding corresponding to the center/side coding of the quantizer.

8. The apparatus of claim 1, wherein the processor is formed to generate a MPEG-2 AAC data stream, wherein in a field Ancillary Data ancillary information for the integer transform algorithm is introduced.

9. The apparatus of claim 1, wherein the quantizer is formed to generate a MDCT block of MDCT spectral values from a time block of temporal audio signal values by means of an MDCT, and quantize the MDCT block using a psychoacoustic model to generate the quantization block comprising quantized MDCT spectral values.

10. The apparatus of claim 9, wherein the generator for generating the integer block is formed to execute an IntMDCT on the time block to generate the integer block comprising IntMDCT spectral values.

11. The apparatus of claim 1, wherein the processor is formed to subject the quantization block to entropy coding, to obtain an entropy-coded quantization block, to subject the rounding block to entropy coding, to obtain an entropy-coded rounding block, and to convert the entropy-coded quantization block to a first scaling layer of a scaled data stream representing the coded audio data, and to convert the entropy-coded rounding block to a second scaling layer of the scaled data stream.

12. The apparatus of claim 11, wherein the processor is further formed to use one of the plurality of code tables depending on the quantized spectral values for the entropy coding of the quantization block, and wherein the processor is further formed to select one of a plurality of code tables depending on a property of a quantizer usable in a quantization for generating the quantization block for the entropy coding of the difference block.

13. The apparatus of claim 1, wherein the processor is formed to output the coded audio data as data stream with a plurality of scaling layers.

14. The apparatus of claim 13, wherein the processor is formed to insert information on the quantization block into a first scaling layer, and to insert information on the difference block into a second scaling layer.

15. The apparatus of claim 13, wherein the processor is formed to insert information on the quantization block into a first scaling layer, and to insert the information on the difference block into at least a second and a third scaling layer.

16. The apparatus of claim 15, wherein in the second scaling layer difference spectral values with reduced accuracy are contained, and in one or more higher scaling layers a residual part of the difference spectral values is contained.

17. The apparatus of claim 15, wherein the processor is formed to insert at least part of difference spectral values for representation of a low-pass filtered signal into a second scaling layer, and to insert a difference between the difference spectral values in the second scaling layer and original difference spectral values into at least one further scaling layer.

18. The apparatus of claim 15, wherein the processor is formed to insert at least part of different spectral values up to a certain cut-off frequency into a second scaling layer, and to insert at least part of difference spectral values from the certain cut-off frequency to a higher frequency into a third scaling layer.

19. The apparatus of claim 15, wherein the information on the difference block includes binarily coded difference spectral values, wherein the second scaling layer for difference spectral values includes a number of bits from a most significant bit to a less significant bit for a difference spectral value, and wherein the third scaling layer includes a number of bits starting from a less significant bit to a least significant bit.

20. The apparatus of claim 19, wherein the time-discrete audio signal is present in form of samples with a width of 24 bits, and wherein the processor is formed to insert more significant 16 bits of difference spectral values into the second scaling layer, and to insert residual 8 bits of a difference spectral value into the third scaling layer, so that a decoder reaches CD quality using the second scaling layer, wherein a decoder reaches studio quality using also the third scaling layer.

21. A computer implemented method of coding a time-discrete audio signal to obtain coded audio data, comprising the computer implemented steps of inputting a time-discrete audio signal;

providing a quantization block of spectral values of said time-discrete audio signal quantized using a psychoacoustic model;

inversely quantizing the quantization block and rounding the inversely quantized spectral values to obtain a rounding block of rounded inversely quantized spectral values;

generating an integer block of integer spectral values using an integer transform algorithm formed to generate the integer block of spectral values from a block of integer time-discrete samples;

forming a difference block depending on a spectral value-wise difference between the rounding block and the integer block, to obtain a difference block with difference spectral values; and processing the quantization block and the difference block to generate coded audio data including information on the quantization block and information on the difference block; and outputting said coded audio data.

22. An apparatus for decoding coded audio data having been generated from a time-discrete audio signal by providing a quantization block of spectral values of the time-discrete audio signal quantized using a psychoacoustic model, by inversely quantizing the quantization block and rounding the inversely quantized spectral values to obtain a rounding block of rounded inversely quantized spectral values, by generating of an integer block of integer spectral values using an integer transform algorithm formed to generate the integer block of spectral values from a block of integer time-discrete samples, and by forming a difference block depending on a spectral value-wise difference between the rounding block and the integer block, to obtain a difference block with difference spectral values, comprising:

a processor for processing the coded audio data to obtain a quantization block and a difference block;

an inverse quantizer for inversely quantizing and rounding the quantization block to obtain an integer inversely quantized quantization block;

a combiner for spectral value-wise combining the integer quantization block and the difference block to obtain a combination block; and a generator for generating a temporal representation of the time-discrete audio signal using the combination block and using an integer transform algorithm inverse to the integer transform algorithm.

23. The apparatus for decoding of claim 22, wherein the coded audio data is scaled and includes a plurality of scaling layers, wherein the processor for processing the coded audio data is formed to ascertain the quantization block from the coded audio data as first scaling layer, and to ascertain the difference block from the coded audio data as second scaling layer.

24. The apparatus of claim 22, wherein the coded audio data is scaled and includes a plurality of scaling layers, and wherein the processor for processing coded audio data is formed to ascertain the quantization block from the coded audio data as first scaling layer, and to ascertain low-pass filtered difference spectral values as second scaling layer.

25. The apparatus of claim 22, wherein the information on the difference block includes binaurally coded difference spectral values, wherein the coded audio data is scaled and includes a plurality of scaling layers, wherein the processor for processing the coded audio data is formed to ascertain the quantization block from the coded audio data as first scaling layer, and to extract a representation of the difference spectral values with reduced accuracy as second scaling layer.

26. The apparatus of claim 25, wherein processor for processing the coded audio data is formed to extract a number of bits starting from a most significant bit to a less significant bit, which is more significant than a least significant bit of a difference spectral value, as second scaling layer, and wherein the generator for generating a temporal representation of the time-discrete audio signal is formed to synthetically generate missing bits for a difference spectral value before using the integer transform algorithm.

27. The apparatus of claim 26, wherein the generator is formed to perform an upscaling of the second scaling layer for the synthetical generation, wherein in the upscaling a scale factor is used, which equals $2^n$, wherein n is the number of less significant bits not contained in the second scaling layer, or to employ a dithering algorithm for the synthetical generation.

28. The apparatus of claim 22, wherein the coded audio data is scaled and includes a plurality of scaling layers, and wherein the processor for processing the coded audio data is formed to ascertain the quantization block of the coded data as first scaling layer, and to ascertain difference spectral values up to a first cut-off frequency as second scaling layer, wherein the first cut-off frequency is smaller than the maximum frequency of a difference spectral value, which may be generated in a coder.

29. The apparatus of claim 28, wherein the generator for generating a temporal representation is formed to set input values in an integer transform algorithm of full length, which are above the cut-off frequency of the second scaling layer, to a predeteimined value, and to downsample the temporal representation of the time-discrete audio signal after using the inverse integer transform algorithm by a factor chosen corresponding to a ratio of a maximum frequency of a difference spectral value, which may be generated by a coder, and the cut-off frequency.

30. The apparatus of claim 29, wherein the predetermined value for all input values above the cut-off frequency is zero.

31. A computer implemented method of decoding coded audio data, the coded audio data including information on a quantization block and a difference block, the quantization block representing a result of a quantization of spectral values of a time-discrete audio signal using a psychoacoustic model, and the difference block depending on a spectral value-wise difference between a rounding block of rounded inversely quantized spectral values and an integer block, the rounding block representing rounded inversely quantized spectral values derived from the quantization block, the integer block representing a result of an integer transform algorithm applied on a block of integer time-discrete samples, comprising the computer implemented steps of inputting coded audio data;

processing the coded audio data to obtain the quantization block and the difference block;

inversely quantizing the quantization block and rounding to obtain an integer inversely quantized quantization block;

spectral value-wise combining the integer quantization block and the difference block to obtain a combination block;

generating a temporal representation of the time-discrete audio signal using a combination block and using an integer transform algorithm inverse to the integer transformation algorithm; and outputting said temporal representation of said time-discrete audio signal.

32. A computer readable medium encoded with instructions capable of being executed by a computer to implement a method of coding a time-discrete audio signal to obtain coded audio data, the method comprising the computer implemented steps of inputting a time-discrete audio signal;

providing a quantization block of spectral values of said time-discrete audio signal quantized using a psychoacoustic model;

inversely quantizing the quantization block and rounding the inversely quantized spectral values to obtain a rounding block of rounded inversely quantized spectral values;

generating an integer block of integer spectral values using an integer transform algorithm formed to generate the integer block of spectral values from a block of integer time-discrete samples;

forming a difference block depending on a spectral value-wise difference between the rounding block and the integer block, to obtain a difference block with difference spectral values;

processing the quantization block and the difference block to generate coded audio data including information on the quantization block and information on the difference; and outputting said coded audio data.

33. A computer readable medium encoded with instructions capable of being executed by a computer to implement a method of decoding coded audio data having been generated from a time-discrete audio signal by providing, inversely quantizing, generating, forming, and processing, comprising the computer implemented steps of inputting coded audio data;

processing the coded audio data to obtain the quantization block and the difference block;

inversely quantizing the quantization block and rounding to obtain an integer inversely quantized quantization block;

spectral value-wise combining the integer quantization block and the difference block to obtain a combination block;

generating a temporal representation of the time-discrete audio signal using a combination block and using an integer transform algorithm inverse to the integer transformation algorithm; and outputting said temporal representation of said time-discrete audio signal.

34. An apparatus for decoding coded audio data, the coded audio data including information on a quantization block and a difference block, the quantization block representing a result of a quantization of spectral values of a time-discrete audio signal using a psychoacoustic model, and the difference block depending on a spectral value-wise difference between a rounding block of rounded inversely quantized spectral values and an integer block, the rounding block representing rounded inversely quantized spectral values derived from the quantization block, the integer block of integer time-discrete samples, comprising:

a processor for processing the coded audio data to obtain the quantization block and the difference block;

an inverse quantizer for inversely quantizing and rounding the quantization block to obtain an integer inversely quantized quantization block;

a combiner for spectral value-wise combining the integer quantization block and the difference block to obtain a combination block; and a generator for generating a temporal representation of the time-discrete audio signal using the combination block and using an integer transform algorithm inverse to the integer transform algorithm.

* * * * *